US010515595B2

(12) United States Patent
Seong et al.

(10) Patent No.: US 10,515,595 B2
(45) Date of Patent: Dec. 24, 2019

(54) DISPLAY APPARATUS AND METHOD FOR DRIVING THE SAME

(71) Applicant: SAMSUNG ELECTRONICS CO., LTD., Suwon-si, Gyeonggi-do (KR)

(72) Inventors: Hwa-seok Seong, Suwon-si (KR); Hui-jung Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/846,702

(22) Filed: Dec. 19, 2017

(65) Prior Publication Data

US 2018/0182306 A1 Jun. 28, 2018

Related U.S. Application Data

(60) Provisional application No. 62/438,713, filed on Dec. 23, 2016.

(30) Foreign Application Priority Data

Oct. 17, 2017 (KR) ..... 10-2017-0134831

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/36* (2013.01); *G09G 3/3648* (2013.01); *G09G 2300/0452* (2013.01); *G09G 2320/0238* (2013.01); *G09G 2320/064* (2013.01); *G09G 2320/0646* (2013.01);
(Continued)

(58) Field of Classification Search
CPC ... G09G 2300/0452; G09G 2320/0238; G09G 2320/064; G09G 2320/0646; G09G 2360/141; G09G 2360/144; G09G 2360/16; G09G 3/3406; G09G 3/3426; G09G 3/36; G09G 3/3648
See application file for complete search history.

(56) References Cited

U.S. PATENT DOCUMENTS 8,552,967 B2 10/2013 Nakanishi
8,760,385 B2 6/2014 Kwon et al.
(Continued)

FOREIGN PATENT DOCUMENTS

JP 2009-116205 5/2009
KR 10-0983731 9/2010
(Continued)

OTHER PUBLICATIONS

Extended Search Report dated May 14, 2018 in counterpart European Patent Application No. 17209830.3.

*Primary Examiner* — Viet D Pham
(74) *Attorney, Agent, or Firm* — Nixon & Vanderhye P.C.

(57) ABSTRACT

A display apparatus is provided. The display apparatus includes a display panel, a backlight, a sensor, and a processor configured to drive the backlight unit so as to provide the display panel with light. The processor acquires a current duty for driving the backlight unit based on pixel information on an input image, acquires a gain value of the current duty based on ambient illumination sensed by the sensor and a ratio of a black pixel value included in the input image, and drives the backlight unit by applying the acquired gain value to the current duty.

20 Claims, 23 Drawing Sheets

(52) U.S. Cl.
CPC . *G09G 2360/141* (2013.01); *G09G 2360/144* (2013.01); *G09G 2360/16* (2013.01)

(56) References Cited

U.S. PATENT DOCUMENTS

| | | | | |
|---|---|---|---|---|
| 9,230,485 | B2 | 1/2016 | Byun et al. | |
| 9,336,750 | B2 | 5/2016 | Zhang et al. | |
| 2010/0073276 | A1 | 3/2010 | Koike et al. | |
| 2011/0292018 | A1 | 12/2011 | Kubota et al. | |
| 2014/0160180 | A1 | 6/2014 | Oda et al. | |
| 2014/0225935 | A1 | 8/2014 | Lee et al. | |
| 2014/0292632 | A1* | 10/2014 | Chen | G09G 3/3406 345/102 |
| 2017/0110064 | A1* | 4/2017 | Zhang | G09G 3/2018 |
| 2017/0110065 | A1* | 4/2017 | Zhang | G09G 3/2018 |

FOREIGN PATENT DOCUMENTS

| | | |
|---|---|---|
| KR | 10-2012-0050674 | 5/2012 |
| KR | 10-1329969 | 11/2013 |

* cited by examiner

DISPLAY APPARATUS AND METHOD FOR DRIVING THE SAME

CROSS-REFERENCE TO RELATED APPLICATIONS

This application is based on and claims the benefit of priority under 35 U.S.C. Section 119 from Korean Patent Application No. 10-2017-0134831, filed on Oct. 17, 2017, in the Korean Intellectual Property Office, and also is based on and claims the benefit of priority from U.S. Provisional Application No. 62/438,713, filed on Dec. 23, 2016, in the United States Patent and Trademark Office, the disclosures of which are incorporated herein by reference in their entireties.

BACKGROUND

1. Field

The instant disclosure generally relates to a display apparatus and/or a method for driving the same, and more particularly, to a display apparatus which includes backlights and/or a method for driving the same.

2. Description of the Related Art

A liquid crystal display (LCD) apparatus refers to an apparatus which displays a desired image via a liquid crystal layer provided between at least first and second transparent insulating substrates, changing a molecule arrangement of a liquid crystal material by adjusting a strength of an electric field formed on and/or across the liquid crystal (LC) layer, and thus controlling an amount of light penetrating the LCD apparatus.

A liquid crystal display panel may be classified into, for example, a Twisted Nematic (TN) panel, an In-Plane Switching (IPS) panel, a Vertical Alignment (VA) panel, or the like depending upon a driving method of the liquid crystal, the LC material, electrode design, polarizer arrangement, and so forth.

VA panels were developed to solve a wide viewing angle problem associated with conventional TN panels. Light from backlights of VA panels is blocked (e.g., by a front polarizer) when liquid crystal molecules in the liquid crystal layer are arranged vertically (e.g., in an OFF state), and thus the VA panel may display a dark color. However, conventional VA type LCD panels have a problem in that black visibility from the side is weak.

SUMMARY

Example embodiments of the present disclosure have been provided to address the aforementioned and/or other problems and disadvantages occurring in the related art, and an aspect of an example embodiment of the present disclosure is to provide a display apparatus which drives backlights in a local dimming method in order to improve the black visibility under certain viewing condition(s) and a method for driving the same.

According to an example embodiment of the present disclosure, there is provided a display apparatus. The display apparatus includes a display panel, a backlight unit, a sensor, and a processor configured to drive the backlight unit so as to provide the display panel with light. The processor acquires a current duty for driving the backlight unit based at least on pixel information on an input image, acquires a gain value of the current duty based at least on ambient illumination sensed by the sensor(s) and a ratio of a black pixel value included in the input image (how much of the input image is desired to be black), and drives the backlight unit by applying the acquired gain value to the current duty.

The processor may identify the input image as a plurality of block regions, count the number of blocks where an average value of each block region is lower than a predetermined threshold value, and acquire the ratio of the black pixel value.

If the ambient illumination is lower than a predetermined threshold value, and the ratio of the black pixel value in the input image is higher than a predetermined ratio, the processor may acquire a gain value for decreasing the current duty and apply the acquired gain value to the current duty.

The processor may calculate the gain value so that a decreasing rate of the current duty increases with a higher ratio of the black pixel value in the input image.

The processor may acquire a plurality of current duties for driving at least one light source of the backlight corresponding to respective image regions among a plurality of light sources included in the backlight unit based at least on pixel information on the image regions respectively corresponding to the at least one light source and apply the acquired gain value to each of the plurality of current duties.

The processor may acquire a degree of dispersion of the black pixel value based at least on the pixel information on the respective image regions and acquire a gain value of each of the plurality of current duties based at least on the ratio of the black pixel value and the degree of dispersion of the black pixel value.

If the degree of dispersion of the black pixel value is higher than a predetermined degree of dispersion, the processor may adjust a difference of the plurality of current duties to be lower than a predetermined threshold value.

If the degree of dispersion of the black pixel value is lower than a predetermined degree of dispersion, the processor may acquire a gain value of each of the plurality of current duties based on the pixel information on the respective image regions.

The apparatus may further include a storage configured to store at least a first current adjusting curve and a second current adjusting curve. If the ambient illumination is higher than a predetermined threshold value, the processor may apply a current value according to the current duty based on the first current adjusting curve. If the ambient illumination is lower than a predetermined threshold value, the processor may apply a current value according to the current duty based on the second current adjusting curve. The second current adjusting curve may be a curve where a variable quantity of a current according to the current duty appears to be gentle as compared with the first current adjusting curve.

The processor may acquire a compensation value for compensating for a brightness change according to application of the gain value with respect to at least one pixel value other than the black pixel value and compensate the at least one pixel value.

The display panel may be a Liquid Crystal Display (LCD).

According to an example embodiment of the present disclosure, there is provided a method for controlling a display apparatus. The method includes acquiring a current duty for driving a backlight unit based on pixel information on an input image, acquiring a gain value of the current duty based on ambient illumination and a ratio of a black pixel value included in the input image, and driving the backlight unit by applying the acquired gain value to the current duty.

The acquiring the gain value may include identifying the input image as a plurality of block regions, counting the number of blocks where an average value of each block region is lower than a predetermined threshold value, and acquiring the ratio of the black pixel value.

If the ambient illumination is lower than a predetermined threshold value, and the ratio of the black pixel value in the input image being higher than a predetermined ratio, the acquiring the gain value may include acquiring a gain value for decreasing the current duty.

The acquiring the gain value may include calculating the gain value so that a decreasing rate of the current duty increases with a higher ratio of the black pixel value in the input image.

The acquiring the current duty may include acquiring a plurality current duties for driving at least one light source corresponding to respective image regions among a plurality of light sources included in the backlight unit based on pixel information on the image regions respectively corresponding to the at least one light source. The driving the backlight unit may include applying the acquired gain value to each of the plurality of current duties.

The acquiring the gain value may include acquiring a degree of dispersion of the black pixel value based on the pixel information on the respective image regions and acquiring a gain value of each of the plurality of current duties based on the ratio of the black pixel value and the degree of dispersion of the black pixel value.

If the degree of dispersion of the black pixel value is higher than a predetermined degree of dispersion, the method may further include adjusting a difference of the plurality of current duties to be lower than a predetermined threshold value.

If the degree of dispersion of the black pixel value is lower than a predetermined degree of dispersion, the acquiring the gain value may include acquiring a gain value of each of the plurality of current duties based on the pixel information on the respective image regions.

According to an example embodiment of the present disclosure, there is provided a non-transitory computer-readable medium with computer instructions for enabling an electronic apparatus executed by a processor to perform an operation. The operation includes acquiring a current duty for driving a backlight unit based on pixel information on an input image, acquiring a gain value of the current duty based on ambient illumination and a ratio of a black pixel value included in the input image, and applying the acquired gain value to the current duty.

According to the above-described various embodiments of the present disclosure, the black visibility under a dark viewing condition may be improved thereby enhancing user convenience.

BRIEF DESCRIPTION OF DRAWINGS

The above and/or other aspects of the present disclosure will be more apparent by describing certain embodiments of the present disclosure with reference to the accompanying drawings, in which.

DETAILED DESCRIPTION

Figure 1A:
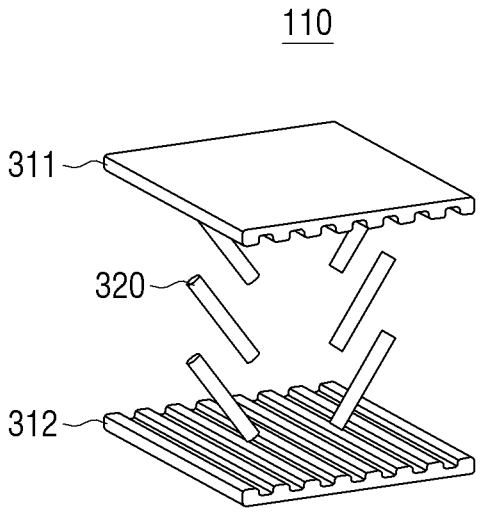
FIGS. 1A, 1B and 1C are diagrams provided to describe a driving method of a Vertical Alignment (VA) panel according to an embodiment disclosed herein.

Certain embodiments are described below in greater detail with reference to the accompanying drawings, in which like reference numerals refer to like parts throughout the several views.

Hereinafter, terms used in the following description will be described briefly in advance of presenting a detailed description on the embodiments of the present disclosure.

In the embodiments disclosed herein, a term 'module' or 'unit' refers to an element which performs one or more functions or operations. The 'module' or 'unit' may be realized as hardware, software, or combinations thereof. A plurality of 'modules' or 'units' may be integrated into at least one module and realized as at least one processor (not shown), except for a case where the respective 'modules' or 'units' need to be realized as discrete specific hardware.

The example embodiments will be described in detail enough to be easily embodied by a person having ordinary skill in the art (hereinafter referred to as 'those skilled in the art') with reference to the accompanying drawings. The present disclosure may be realized as various different forms and is not limited to the embodiments described herein. In the accompanying drawings, a part unrelated to the description is omitted for a more clear description, and like drawing reference numerals are used for the like elements, even in different drawings, throughout the entire specification.

FIG. 1 is a diagram provided to describe characteristics of a display panel according to an example embodiment disclosed herein.

For a display panel realized with non-self emitting elements, for example, a Liquid Crystal Display (LCD) panel, to display an image, a display module should include a backlight. In response to the backlights being activated, an LCD TV, for example, a 46-inch Cold Cathode Fluorescent Lamp (CCFL) LCD TV consumes power of 240 W. The backlights operate 100% even when the backlights do not necessarily need to be activated, for example, when a dark scene is being displayed, which increases power consumption and causes a high temperature of the backlights and the display module. Accordingly, the heat radiated from the backlights may result in excessive thermal gradient, which may affect the characteristics of the LCD. For this reason, backlight brightness, that is, the power consumption is limited as much as possible.

As a way of reducing the power consumption of backlights, backlight dimming is used. The backlight dimming method may be classified into Local dimming which involves dividing a screen into a plurality of regions and individually controlling backlight brightness of each region, and Global dimming which involves decreasing backlight brightness of the entire screen in a lump.

The LCD panel may be divided into a Twisted Nematic (TN) panel, an In-Plane Switching (IPS) panel, a Vertical Alignment (VA) panel, and so on according to a driving method of the liquid crystal.

The TN type LCD panel operates in a way that the liquid crystal molecules are arranged vertically upon application of high voltage across the LC layer, and a black screen in a normally white (NW) type TN LCD is achieved by the front polarizer being oriented to block light which exits the LC layer. For instance, when a NW type TN LCD has crossed (perpendicular) front and rear polarizers, the screen is dark in pixels where high voltage is applied across the LC layer. A TN type LCD may also be of a normally black type, with parallel front and rear polarizers, in which scenario the screen is generally dark in pixels where no voltage (or voltage below the threshold voltage) is applied across the LC. The IPS panel operates in a way that the liquid crystal molecules arranged in a horizontal direction are rotated sideways by a magnetic field.

Figure 1B:
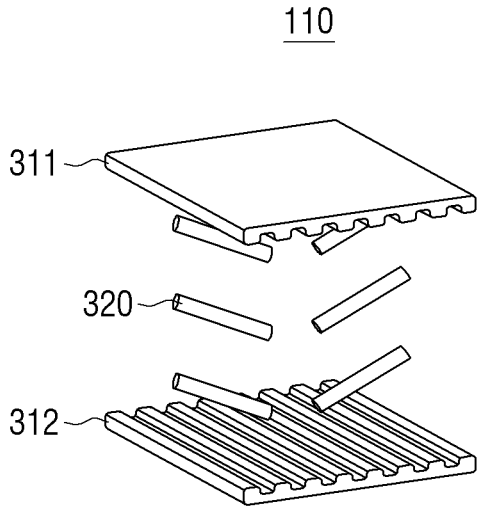
Figure 1C:
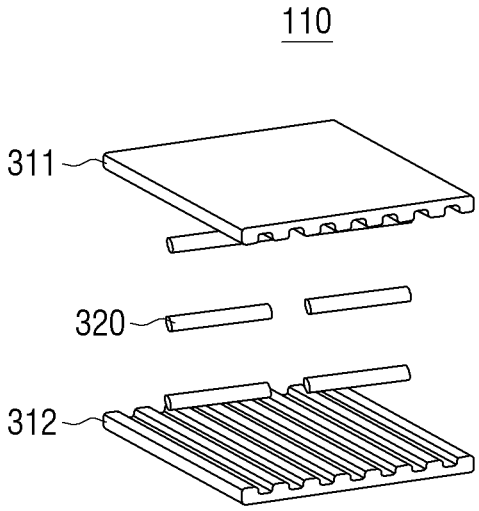

FIGS. 1A to 1C are diagrams provided to describe a driving method of a Vertical Alignment (VA) type LCD panel according to an example embodiment disclosed herein.

Figure 2:
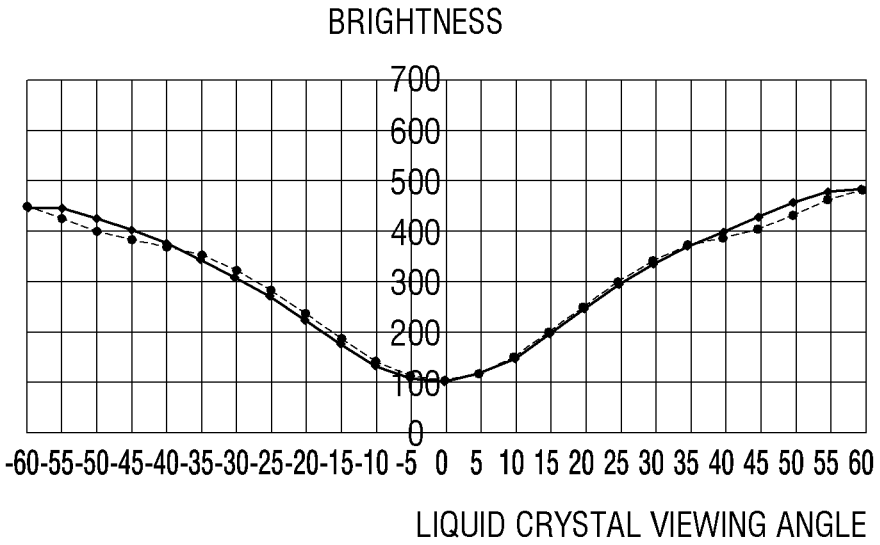
FIG. 2 is a block diagram illustrating a structure of a display apparatus according to an embodiment disclosed herein.

As illustrated in FIG. 1A, the liquid crystal molecules of the VA panel are arranged substantially vertically when no significant voltage is applied across the LC layer, and in response to significant voltage being applied across the LC layer the liquid crystal molecules are driven horizontally as illustrated in FIG. 1B (intermediate voltage) and in FIG. 1C (maximum voltage). When the liquid crystal molecules are arranged vertically as shown in FIG. 1A for example, the light of the backlights is blocked by a front polarizer of the display, and the VA panel may display a dark color. When the liquid crystal molecules are arranged horizontally in response to the voltage applied across the LC (e.g., see FIG. 1C), the light from the backlight passes through both the LC layer and the front polarizer, and the VA panel may display a white color. In other words, a panel with a liquid crystal cell structure where side brightness is far higher than frontal brightness has a problem that the black visibility from the side is weak as illustrated in FIG. 2. Accordingly, the embodiments disclosed herein will describe techniques for applying backlight dimming to improve the black visibility of an LCD panel across a wide range of viewing angles.

Figure 3:
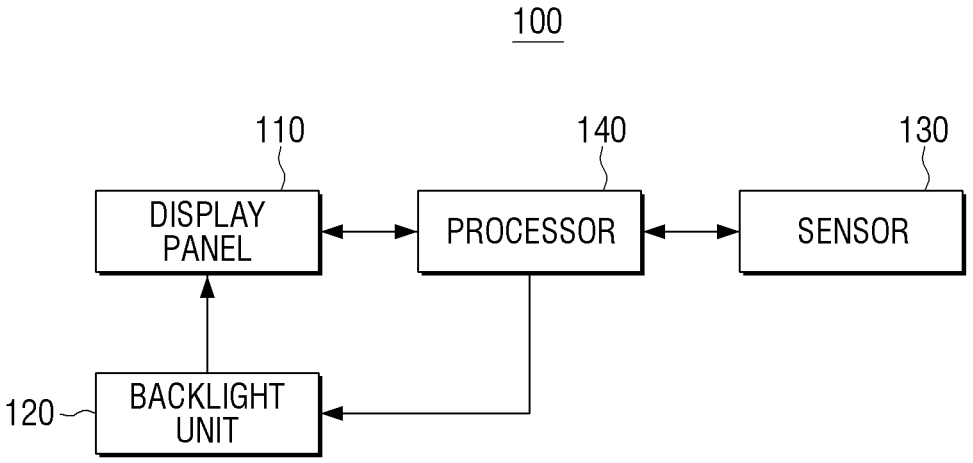
FIG. 3 is a block diagram illustrating a structure of a display apparatus according to an embodiment disclosed herein.

FIG. 3 is a block diagram illustrating a structure of a display (e.g., LCD) apparatus according to an example embodiment disclosed herein.

Referring to FIG. 3, a display apparatus 100 includes a display panel 110, a backlight unit 120, at least one sensor 130, and at least one processor 140.

The display apparatus 100 may be realized as a smart phone, a tablet Personal Computer (PC), a smart television (TV), an internet TV, a web TV, an Internet Protocol Television (IPTV), Signage, a PC, a monitor, or the like, but not limited thereto. That is, the display apparatus 100 may be realized as various kinds of apparatuses which provide a display function, such as, a Large Format Display (LFD), Digital Signage, a Digital Information Display (DID), a video wall, a projector display, and so on.

The display panel 110 may includes a plurality of pixels, and each pixel may include a plurality of sub pixels. By way of example, when there are a plurality of lights in a backlight, each pixel may consist of three sub pixels corresponding to red, green, and blue lights (RGB), but not limited thereto. Each pixel may further include sub pixels corresponding to Cyan, Magenta, Yellow, or Black on top of the sub pixels corresponding to red, green, and blue lights (RGB). The display panel 110 may be realized as a Liquid Crystal Display panel. Further, the display panel 110 may be realized as any kinds of display panel capable of performing backlight dimming according to an embodiment disclosed herein.

The backlight unit 120 may irradiate the light to the display panel 110.

To be specific, the backlight unit 120 may irradiate the light to the display panel 110 from a rear surface of the display panel 110, that is, a surface opposite to a surface where an image is displayed.

The backlight unit 120 may include a plurality of light sources. The plurality of light sources may include linear light sources, such as, lamps, or point light sources, such as, Light-Emitting Diode (LED) type sources, but the sources of the backlight 120 are not limited thereto. The backlight unit 120 may be realized as a direct type backlight unit or an edge-mounted type backlight unit. The light source(s) of the backlight unit 120 may include any one or two or more light sources from among Light Emitting Diode (LED), Hot Cathode Fluorescent Lamp (HCFL), Cold Cathode Fluorescent Lamp (CCFL), External Electrode Fluorescent Lamp (EEFL), Electroluminescent Display Panel (ELP), and Flat Fluorescent Lamp (FFL).

According to an embodiment, the backlight unit 120 may be realized so as to comprise a plurality of LED modules and/or a plurality of LED cabinets. The LED module may include a plurality of LED pixels. As an example, the LED modules may be realized as RGB LEDs, and the RGB LEDs may include a red LED, a green LED, and a blue LED.

The sensor 130 may sense external light, so as to sense at least ambient lighting conditions proximate the display 100.

To be specific, the sensor 130 may sense at least one of various characteristics of the light, such as, illumination, strength, a color, an incidence direction, an incidence dimension, and/or a degree of distribution. According an example embodiment, the sensor 130 may be realized as one or more of an illumination sensor, a temperature sensor, a light quantity sensing layer, and/or a camera.

To be specific, the sensor 130 may be realized as an illumination sensor for sensing RGB lights, but is not limited thereto. That is, the sensor 130 may be realized as any kind of device capable of sensing light, for example, a white sensor, an IR sensor, an IR+RED sensor, a HRM sensor, or a camera.

The illumination sensor 130 may use various photoelectric cells and for measurement of very low illumination, and/or may use a photoelectric tube. By way of example, a CDS illumination sensor may be installed in the display apparatus 100 and sense illumination in both directions. In this case, the illumination sensor may be installed at one or more predetermined regions on both surfaces of the display apparatus 100 or may be installed in each pixel unit on both surfaces. For example, the display apparatus 100 may include an illumination sensor where a Complementary Metal-Oxide Semiconductor (CMOS) sensor is expanded to correspond to a size of the display panel 110, and the illumination sensor may sense illumination of each region or each pixel. In this case, the CDS illumination sensor may sense the light around the display apparatus 100, and an A/D converter may convert a voltage acquired through the CDS illumination sensor to a digital value and transmit the converted digital value to the processor 140.

The display apparatus 100 may include one or more sensors 130, and the plurality of sensors may be installed at different locations where illumination in different directions may be measured. As an example, a second sensor may be installed at a location for sensing the illumination in a different direction spaced more than 90 degrees apart from a location of a first sensor. As another example, the sensor 130 may be installed inside a glass of the display panel 110.

The processor 140, including processing circuitry, may control overall operations of the display apparatus 100.

According to an example embodiment, the processor 140 may be defined as or include at least one of a Digital Signal Processor (DSP), a microprocessor, a Time Controller (TCON), a Central Processing Unit (CPU), a Micro Controller Unit (MCU), a Micro Processing Unit (MPU), a controller, an Application Processor (AP), a Communication Processor (CP), and an ARM processor. Further, the processor 140 may be realized as a System on Chip (SoC) or a Large Scale Integration (LSI) with a processing algorithm or may be realized as a Field-Programmable Gate Array (FPGA).

The processor 140 may drive the backlight unit 120 so as to provide the display panel 110 with light. To be specific, the processor 140 may adjust and output at least one of a supply time and/or strength of a driving current (or a driving voltage) supplied to the backlight unit 120.

The processor 140 may control the brightness of the light sources included in the backlight unit 120 through Pulse Width Modulation (PWM) where a duty ratio varies and/or by varying the strength of the current. A PWM signal may control a lighting ratio of the light sources, and the duty ratio (%) may be determined according to a dimming value inputted from the processor 140.

The processor 140 may be realized so as to include a driver Integrated Circuit (IC) for driving the backlight unit 120. For example, the processor 140 may be realized as a digital signal processor (DSP) and/or realized as one chip with a digital driver IC. The driver IC may be realized as hardware separately from the processor 140. By way of example, if the light sources of the backlight unit 120 are realized as LED elements, the driver IC may be realized as at least one LED driver which controls a current applied to the LED elements. According to an example embodiment, the LED driver may be installed at a rear end of the power supply (for example, Switching Mode Power Supply (SMPS)) so as to receive voltage from the power supply. According to another example embodiment, the LED driver may receive the voltage from other separate power supply device(s). Further, the LED driver may be realized as a module in which the SMPS and the LED driver are combined.

The processor 140 may acquire a dimming rate for driving the backlight unit 120, that is, a lighting duty of a current (hereinafter referred to as 'current duty') based on pixel information of an input image (or a physical quantity of pixels). The pixel information may be at least one of an average pixel value, a maximum pixel value (or a peak pixel value), a minimum pixel value, an intermediate pixel value, and/or an Average Picture Level (APL) of each block region to be displayed. The pixel value may include at least one of a brightness value (or a gradation value) and/or a color coordinate value. Hereinafter, it is assumed that the pixel information is the APL for convenience in explanation.

The processor 140 may acquire the dimming rate for driving the backlight unit 120, that is, the current duty, for each section based on pixel information on each predetermined section of an input image, for example, APL information. The predetermined section may be a frame unit, but is not limited thereto. The predetermined section may be a plurality of frame sections and/or scene sections. The processor 140 may acquire the current duty according to the pixel information based on a predetermined function (or an operation algorithm), or current duty information according to the pixel information may be pre-stored in a form of a look-up table or a graph, for example.

By way of example, the processor 140 may convert pixel data (e.g., RGB) for each frame to brightness levels according to a predetermined conversion function, divide the sum of the brightness levels by the total number of pixels, and calculate the APL for each frame, although the technique is not so limited. That is, the processor 140 may calculate the APL according to various conventional APL calculating methods. Subsequently, the processor 140 may determine a current duty corresponding to each APL value by using a function for controlling a current duty to be 100% in an image frame where the APL is a predetermined value (for example, 80%) and decreasing a current duty of an image frame with an APL value less than 80% to be inversely proportional to the APL value linearly or non-linearly. If the current duty corresponding to the APL value is stored in a look-up table, the processor 140 may read the current duty from the look-up table by using the APL as a read address.

The processor 140 may identify a screen as a plurality of regions and drive the backlight unit 120 according to the local dimming method for individually controlling the backlight brightness for each region.

To be specific, the processor 140 may identify a screen as a plurality of screen regions which may be controlled individually according to implementation of the backlight unit 120 and acquire the current duty for individually driving the light sources of the backlight unit 120 corresponding to the respective image regions based on the pixel information, for example, the APL information, of an image to be displayed (hereinafter referred to as 'image region') of each screen region. Hereinafter, each backlight region corresponding to the plurality of respective image regions will be called a 'backlight block' for that image region, for convenience in explanation. By way of example, the respective backlight blocks may include at least one light source, for example, a plurality of light sources.

Figure 4A:
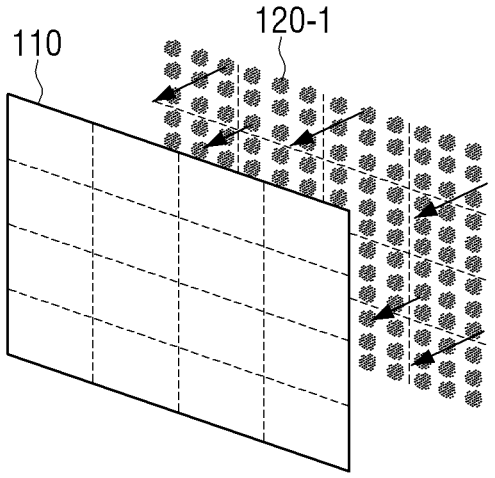
FIGS. 4A and 4B are diagrams provided to describe a local dimming method according to an embodiment disclosed herein.

According to an example embodiment, the backlight unit 120 may be realized as a direct type backlight unit 120-1 as illustrated in FIG. 4A. For example, the direct type backlight unit 120-1 may be realized as a structure where multiple optical sheets and a diffuser plate are stacked at a lower part of the display panel 110, and multiple light sources are arranged under the diffuser plate. Thus, light emitted from the light sources of the backlight unit 120-1 proceeds through the diffuser plate and optical sheet(s) before reaching the display panel 110.

The direct type backlight unit 120-1 may be divided into a plurality of backlight blocks based on an arrangement of the plurality of the light sources as illustrated in FIG. 4A. In this case, the plurality of backlight blocks may be driven individually according to the current duty based on image information of a corresponding screen region as illustrated.

Figure 4B:
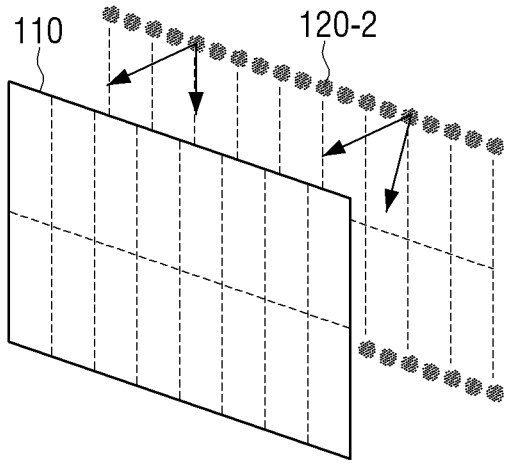

According to another example embodiment, the backlight unit 120 may be realized as an edge type backlight unit 120-2 as illustrated in FIG. 4B. For example, the edge type backlight unit 120-2 may be realized as a structure where multiple optical sheets and a light guide plate are stacked at a lower part of the display panel 110, and multiple the light sources are arranged at the side (e.g., either along one edge side, or alternative along two edge sides of the light guide plate) of the light guide plate.

The edge type backlight unit 120-2 may be divided into a plurality of backlight blocks based on an arrangement of the plurality of the light sources as illustrated in FIG. 4B. In this case, the plurality of backlight blocks may be driven individually according to the current duty based on the image information of the corresponding screen region as illustrated.

Figure 5A:
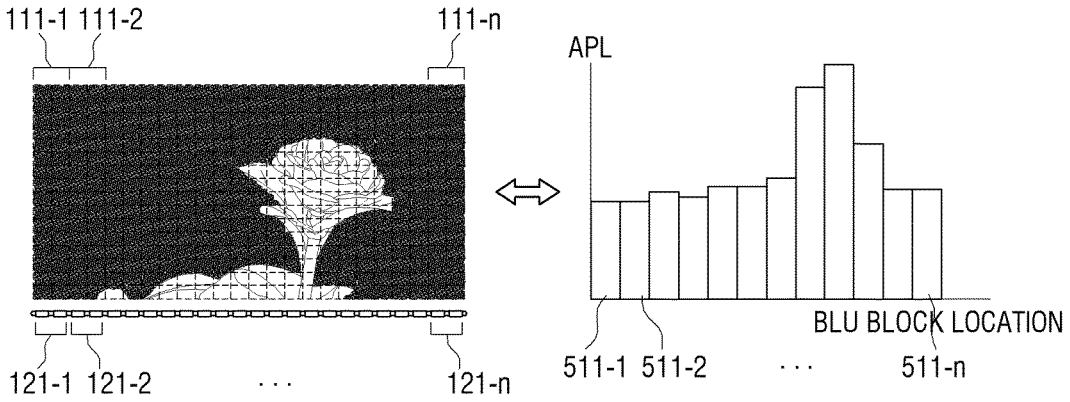
FIGS. 5A and 5B are diagrams provided to describe a method for acquiring a current duty corresponding to each backlight block according to an embodiment disclosed herein.
Figure 5B:
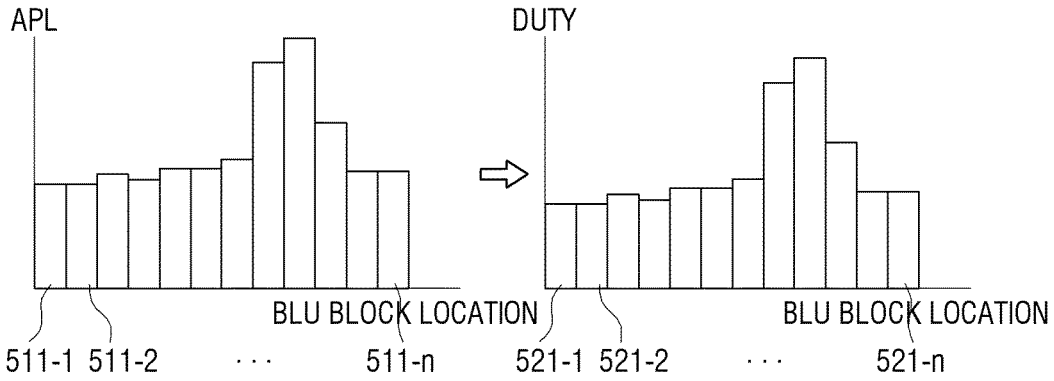

FIGS. 5A and 5B are diagrams provided to describe a method for acquiring a current duty corresponding to each backlight block according to an example embodiment disclosed herein.

If the backlight unit 120 is realized as the edge type backlight unit 120-2 according to an example embodiment, the processor 140 may acquire the pixel information, for example, the APL information on the respective image regions to be displayed in the screen regions corresponding to the respective backlight blocks of the backlight unit (BLU) 120-2 and calculate the current duties of the backlight blocks corresponding to the screen regions based on the acquired pixel information.

For example, as illustrated in the right drawing of FIG. 5A, the processor 140 may calculate the APL information on image regions 111-1 to **111-*n* corresponding to each of backlight blocks 121-1 to 121-*n*. The left drawing of FIG. 5B illustrates an example where APL values 511-1 to 511-*n* of the image regions 111-1 to 111-*n*** are calculated.

As illustrated in FIG. 5B, the processor 140 may calculate current duties 521-1 to **521-*n* of the respective backlight blocks 121-1 to 121-*n* corresponding to the respective screen regions based on the APL values 511-1 to 511-*n* of the respective image regions. For example, the processor 140 may calculate the current duties of the respective backlight blocks 121-1 to 121-*n* by applying a predetermined weighted value to the APL values of the respective image regions. By way of example, the processor 140** may calculate a current duty of an image region where the APL is 10% to be '10%*6=60%' and calculate a current duty of an image region where the APL is 7% to be '7%*6=42%.' However, this is only an example for calculating a current duty, and the current duty may be calculated according to various methods based on the pixel information of each screen region.

According to an example embodiment, the processor 140 may arrange the current duties corresponding to the backlight blocks according to a connection order of the backlight blocks and provide a local dimming driver with the current duties. In this case, the local dimming driver may generate a PWM signal having each current duty received from the processor 140 and drive the respective backlight blocks sequentially based on the generated PWM signal. According to another embodiment, the processor 140 may generate a PWM signal based on the calculated current duties and transmit the generated PWM signal to the local dimming driver.

Further, the processor 140 may acquire a gain value of the current duty based on the ambient illumination sensed by the sensor 130 and the ratio of the black pixel value included in the input image and drive the backlight unit 120 by applying the acquired gain value to a duty of a current (hereinafter referred to as 'gain control'). The ratio of the black pixel value (or a black ratio) may refer to a pixel ratio of low gradation near black (for example, gradation ranging from 0 to 5; a gradation lower than 5 is a black gradation), but not limited thereto. That is, the ratio of the black pixel value may refer to a pixel ratio within a range which may be seen as black to a user. Hereinafter, the ratio of the black pixel value will be called 'black ratio' for convenience in explanation.

According to an example embodiment, the processor 140 may identify the input image as a plurality of block regions and acquire a black ratio by counting the number of blocks where an average value of each block region is lower than a predetermined threshold value. That is, in the example embodiment, the black ratio may be calculated as a ratio of the block regions where the average value is the low gradation close to black (for example, gradation ranging from 0 to 5, but the numerical value is not limited thereto), but not limited thereto. The black ratio may be calculated as a ratio according to the number of pixel values with low gradation near black with respect to the total number of pixels.

Figure 6A:
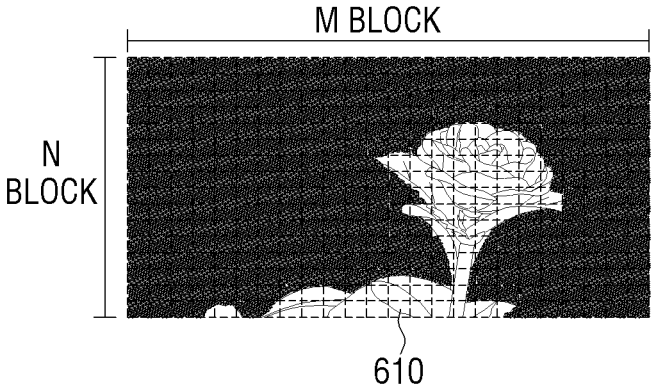
FIGS. 6A and 6B are diagrams provided to describe a method for calculating a black ratio according to an embodiment disclosed herein.
Figure 6B:
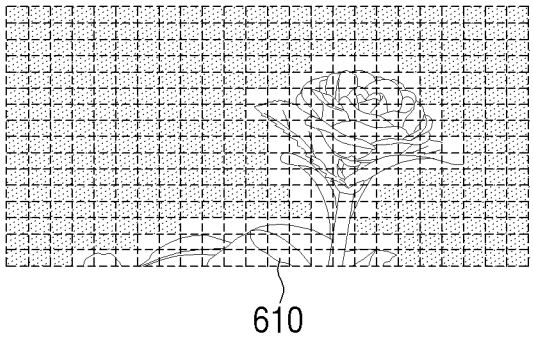

FIGS. 6A and 6B are diagrams provided to describe a method for calculating a black ratio according to an example embodiment disclosed herein.

The processor 140 may identify an input image 610 as a plurality of block regions and calculate a black ratio by counting the number of blocks where an average value of each block region is lower than a predetermined threshold value.

For example, as illustrated in FIG. 6A, the processor 140 may divide an input image frame into M*N number of blocks and calculate a ratio of a block pixel value by counting the number of blocks where an average value of each block region is lower than a certain threshold value. In this case, the threshold value may be determined to be a value which may be identified as black to the user by considering a ratio or distribution of other pixel values included in each block. As an example, when an image is a 8-bit image with 256 gradations, a threshold value may be determined to be 5 gradations.

According to an example embodiment, if the ambient illumination is lower than a predetermined threshold value, and a black ratio of an image is higher than a predetermined ratio, the processor 140 may acquire a gain value for decreasing a current duty of a current and apply the acquired gain value to the current duty. That is, if at least one condition of the ambient illumination is higher than a predetermined threshold value and the black ratio of the input image is lower than a predetermined ratio, the processor 140 may apply the current duty calculated based on the pixel information on the input image to drive the backlight unit 120 without applying the gain value to the current duty.

Hereinafter, in this example embodiment, a condition where the ambient illumination is lower than a predetermined threshold value will be called 'darkroom viewing condition' for convenience in explanation.

The processor 140 may calculate the gain value so that a decreasing rate of the current duty increases with a higher black ratio in an image under a darkroom viewing condition.

Figure 7A:
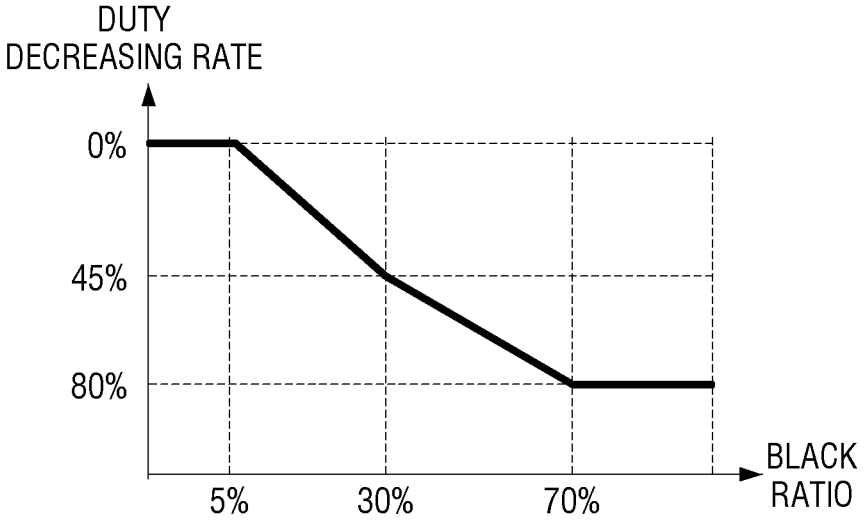
FIGS. 7A and 7B are diagrams provided to describe a method for acquiring a gain value based on ambient illumination and a black ratio according to an embodiment disclosed herein.
Figure 7B:
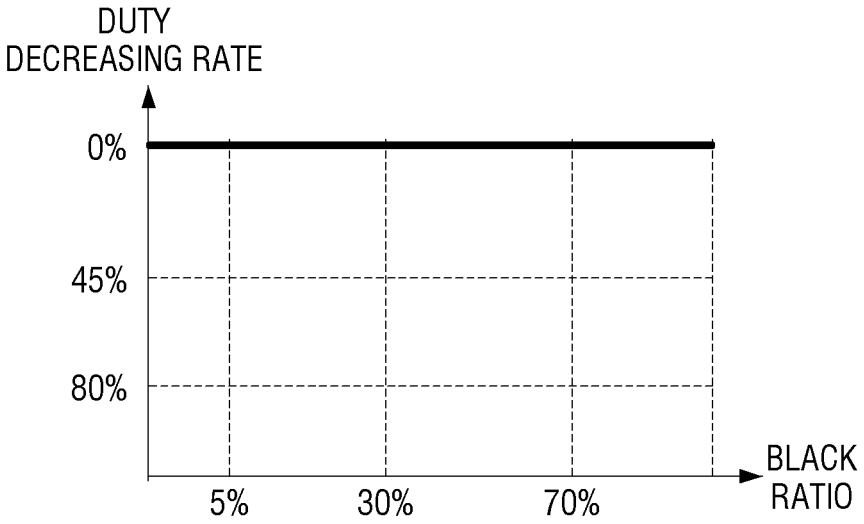

FIGS. 7A and 7B are diagrams provided to describe a method for acquiring a gain value based on ambient illumination and a black ratio according to an example embodiment disclosed herein.

As described above, under a darkroom viewing condition, the decreasing rate of the current duty may be determined based on the black ratio of the image. For example, as illustrated in FIG. 7A, the black ratio of the image and the decreasing rate of the current duty may be proportional to each other linearly, but this is not limited thereto. The black ratio of the image and the decreasing rate of the current duty may be proportional to each other non-linearly or stepwise. In FIG. 7A, the current duty is not decreased if the black ratio is lower than a predetermined first value (for example, 5%), but not limited thereto. That is, the current duty may be decreased linearly or non-linearly according to the black ratio when the black ratio is lower than the first value.

In FIG. 7A, the decreased current duty is maintained if the black ratio is higher than a predetermined second value (for example, 70%), but not limited thereto. That is, the current duty may be decreased linearly or non-linearly according to the black ratio when the black ratio is higher than the second value.

Referring to FIG. 7B, under a bright room viewing condition where the ambient illumination is higher than a predetermined threshold value, the processor 140 may use the current duty acquired based on the pixel information on the image to drive the backlight unit 120 without adjusting, that is, decreasing the current duty based on the black ratio.

According to an example embodiment, the calculated gain value may be applied to the plurality of the current duties in a lump. However, according to another example embodiment, different gain values may be applied to the respective current duties corresponding to the respective backlight blocks.

As an example, in response to determining a viewing condition being a darkroom viewing condition based on the ambient illumination, the processor 140 may acquire the gain value for decreasing the current duty based on the black ratio with respect to the entire input image and apply the acquired gain value to the current duties of the respective backlight blocks in a lump. For example, if the calculated current duties of the respective backlight blocks is a1, a2, . . . , an, and the black pixel value of the input image is higher than a predetermined ratio, for example, 70%, the processor 140 may acquire corrected current duty values by multiplying gain value g calculated based on the ratio by the current duties of the respective backlight blocks a1, a2, . . . , an.

As another example, if the ambient illumination is lower than a predetermined threshold value, the processor 140 may calculate a black ratio of each image region individually, acquire a gain value for decreasing the current duties of the respective backlight blocks based on the calculated black ratio, and apply the acquired gain value to a current duty of a corresponding backlight block individually. For example, if the calculated current duties of the respective backlight blocks is a1, a2, . . . , an, and the black ratios of the respective image regions is b1, b2, . . . , bn, the processor 140 may acquire corrected current duty values by multiplying gain values g1, g2, . . . , gn calculated based on the ratios by the current duties of the corresponding backlight block a1, a2, . . . , an. In this case, the processor 140 may apply a corresponding gain value only to a current duty value of a backlight block corresponding to an image region where the black pixel value is higher than a predetermined ratio, for example, 70%. Further, if the black ratio of the entire input image is higher than a predetermined ratio, for example, 70%, the processor may acquire a corrected current duty values by multiplying the gain values g1, g2, . . . , gn calculated based on the black ratio of each image region by the current duties of the corresponding backlight blocks a1, a2, . . . , an even when the black ratio of the image region is not higher than 70%.

As another example, only if the ambient illumination is lower than a predetermined threshold value, the black ratio of the entire input image being higher than a predetermined ratio, the processor 140 may calculate the black ratios of the image regions individually, acquire the gain values of the current duties of the backlight blocks respectively based on the calculated black ratios, and apply the acquired gain values to the current duties of the corresponding backlight blocks respectively.

In the above example embodiment, the backlights are driven according to the local dimming method, but the present disclosure may be also applied to the global dimming method. By way of example, the processor 140 may calculate the current duty for the global dimming based on the APL information on the input image frame and calculate the gain value of the current duty based on the black ratio of the input image frame.

According to an example embodiment, the processor 140 may acquire the gain value of the current duty based on the degree of dispersion of certain pixel information, as well as the above-described black ratio.

To be specific, for an image where a certain pixel physical quantity disperses, the processor 140 may calculate the gain value so that a difference of current duty gain values corresponds to the respective backlight blocks. In this case, the certain pixel physical quantity may be at least one of a pixel value of the low gradation (for example, black pixel value) and a pixel value of high gradation.

For example, the processor 140 may acquire the gain value of the current duty based on the black ratio and the degree of dispersion of the black pixel value (hereinafter referred to as 'degree of black dispersion').

As an example, if the degree of dispersion of black blocks is higher than a predetermined degree of dispersion, the processor 140 may adjust the gain value according to the black ratio of the respective image regions so that a difference of the current duties to be applied to the respective backlight blocks to be lower than a predetermined threshold value and apply the adjusted gain value to the respective current duties.

As another example, if the degree of dispersion of the black blocks is higher than a predetermined degree of dispersion, the processor 140 may adjust the gain value according to the black ratio of the respective image regions so that a difference of the gain values of the current duties to be applied to the respective backlight blocks to be lower than a predetermined threshold value and apply the adjusted gain value to the respective current duties.

As described above, the black visibility may be improved by reducing the current duty according to the black ratio under the darkroom viewing condition.

The processor 140 may adjust the gain value, that is, the decreasing rate of the current duty based on the degree of dispersion of the blocks where the average value is lower than a predetermined threshold value (hereinafter referred to as 'black block') among the plurality of block regions divided while calculating the black ratio.

Figure 8A:
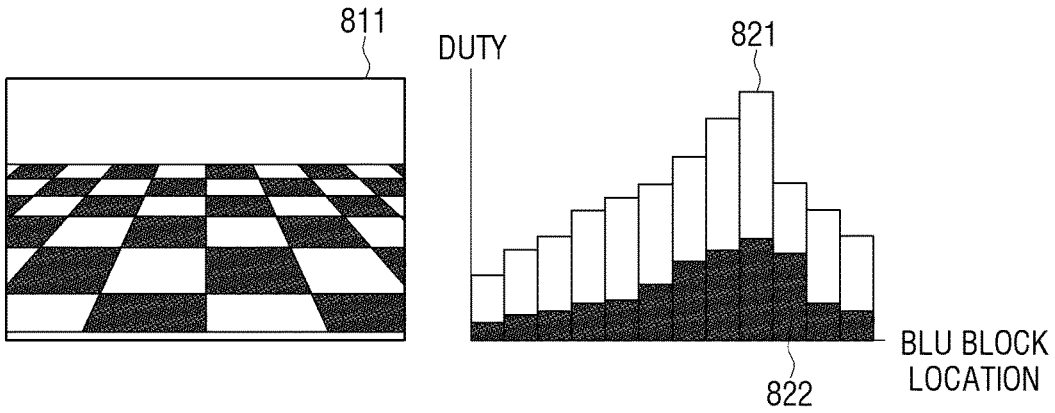
FIGS. 8A and 8B are diagrams provided to describe a method for acquiring a gain value based on a degree of black dispersion according to an embodiment disclosed herein.
Figure 8B:
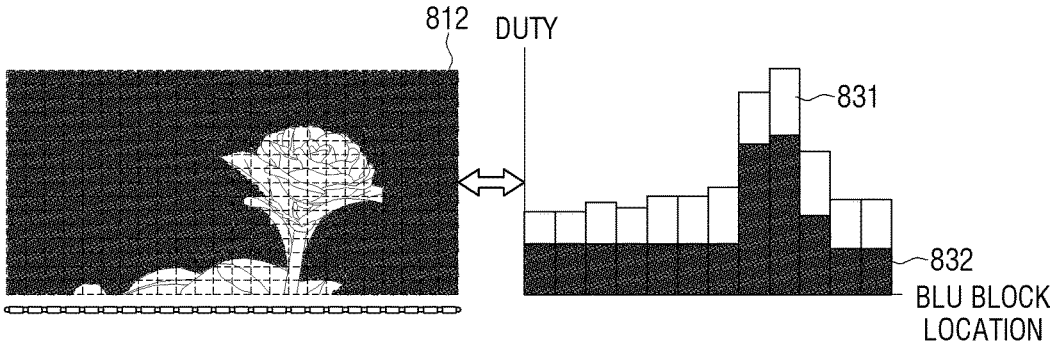

FIGS. 8A and 8B are diagrams provided to describe a method for acquiring a gain value based on a degree of black dispersion according to an example embodiment.

According to an example embodiment disclosed herein, the processor 140 may calculate the gain values of the current duties to be applied to the respective backlight blocks based on the degree of dispersion of the black blocks (or a degree of concentration) among the plurality of blocks divided while calculating the black ratio.

As an example, in case of an image 811 where the degree of dispersion of the black blocks among the plurality of blocks is higher than a predetermined degree of dispersion as illustrated in the right drawing of FIG. 8A, the processor 140 may adjust the gain value according to the black ratio of the respective image regions so that the difference of the current duties to be applied to the backlight blocks to be lower than a predetermined threshold value and apply the adjusted gain value to the respective current duties. The difference of the current duties applied to the respective backlight blocks may become decreased by applying the gain value in this manner. If necessary, the processor 140 may adjust the gain value so that a difference of the gain values calculated with respect to the respective current duties to be lower than a predetermined threshold value.

As another example, in case of an image 812 where the degree of dispersion of the black blocks among the plurality of blocks is lower than a predetermined degree of dispersion as illustrated in the right drawing of FIG. 8B, the processor 140 may apply the gain value according to the black ratio of the respective image regions to the respective current duties without adjustment. In this case, the difference of the current duties applied to the respective backlight blocks may depend on only the black ratio of the respective image regions as illustrated in FIG. 8B.

In response to the current duty being decreased by gain control according to the black ratio, the processor 140 may adjust a size of a current based on the decreased duty.

If the ambient illumination is higher than a predetermined threshold value, the processor 140 may adjust a current value according to the current duty based on a first current adjusting curve, and if the ambient illumination is lower than a predetermined threshold value, may apply the current value according to the current duty based on a second current adjusting curve. The second current adjusting curve may be a curve where the variation of the current appears to be gentle as compared with the first current adjusting curve for at least the following reasons.

Figure 9:
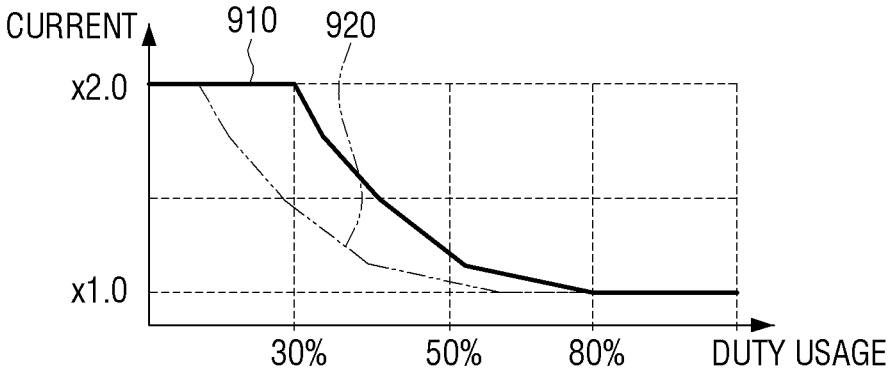
FIG. 9 is a diagram provided to describe a method for varying a current by gain control according to an embodiment disclosed herein.

Generally, the display apparatus 100 may adjust the current according to the current duty determined based on a certain current adjusting curve (for example, a first current adjusting curve 910 of FIG. 9). However, according to an example embodiment, when the display apparatus 100 decreases the current duty in order to increase the black visibility under the darkroom viewing condition and then increases the current based on the first current adjusting curve, a blackout(floating of black) problem may be caused. Accordingly, the display apparatus 100 may adjust the size of the current according to the current duty based on the second current adjusting curve 920 according to an example embodiment. In this case, the display apparatus 100 may do not increase the current size a lot even when the current size is small, thereby preventing or reducing the blackout problem due to the current adjustment.

Further, according to an example embodiment disclosed herein, the processor 140 may acquire a compensation value for compensating a brightness change according to application of the gain value with respect to at least one pixel data other than the black pixel value and compensate a pixel value of the pixel.

Figure 10:
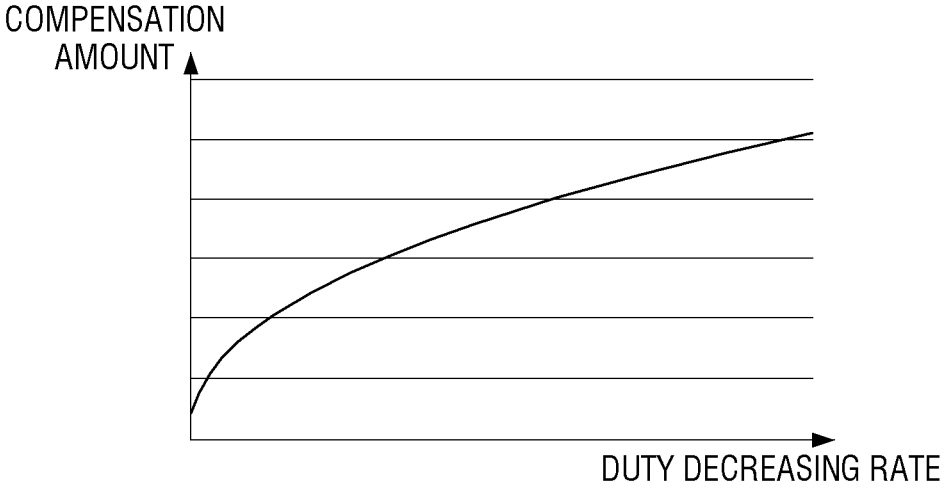
FIG. 10 is a diagram provided to describe a method for compensating pixel data by duty gain control according to an embodiment disclosed herein.

FIG. 10 is a diagram provided to describe a method for compensating pixel data by duty gain control according to an example embodiment.

According to an example embodiment disclosed herein, as described above, the processor 140 may compensate pixel data, that is, a gradation value of an image in order to compensate a pixel brightness value according to the gain control of the current duty since the black visibility is increased in response to the current duty being decreased by the gain control according to the above-described embodiment whereas the brightness of pixel data other than the black pixel data is also changed.

As an example, the processor 140 may calculate the compensation amount of the pixel data so to be non-linearly proportional to the duty decreasing rate by the gain control as illustrated in FIG. 10. As another example, the processor 140 may calculate the compensation amount of the pixel data to be linearly proportional to the duty decreasing rate by the gain control. In this case, the compensation amount may be pre-calculated and stored based on a duty decreasing amount (or duty decreasing rate) and the pixel data value, or the processor 140 may calculate the compensation amount in real time. The processor 140 may compensate the pixel data of a pixel region which is not the black pixel value based on the corresponding pixel data value, that is, an image gradation value. For example, if the pixel data value is 200 gradations, the processor 140 may compensate the pixel data to be 212 gradations and prevent/reduce the brightness of the pixel data which is not black from being distorted.

Figure 11A:
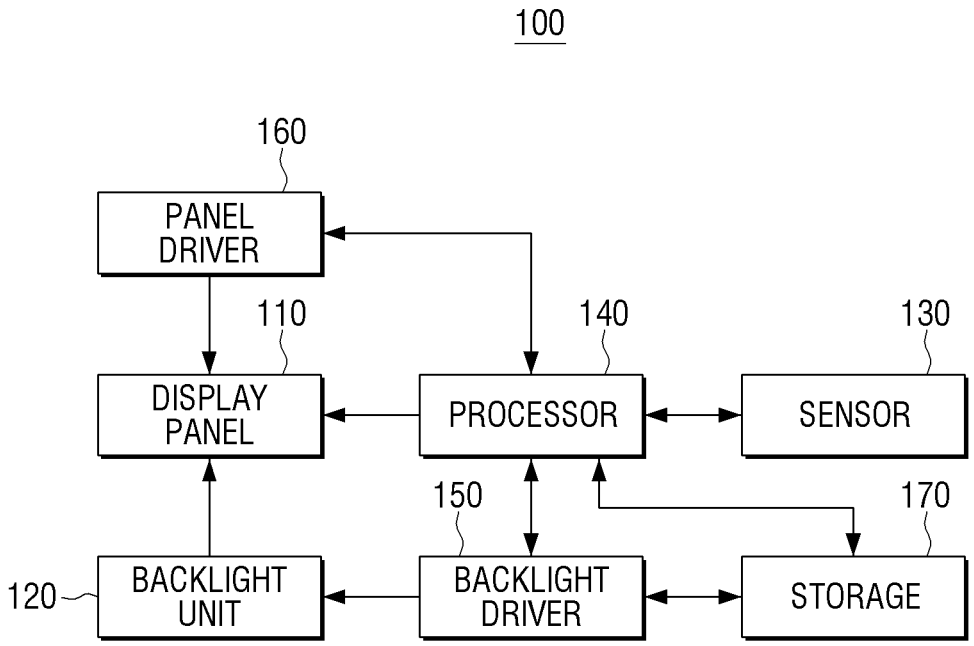
FIGS. 11A and 11B are diagrams illustrating a detailed structure of a display apparatus according to an embodiment disclosed herein.
Figure 11B:
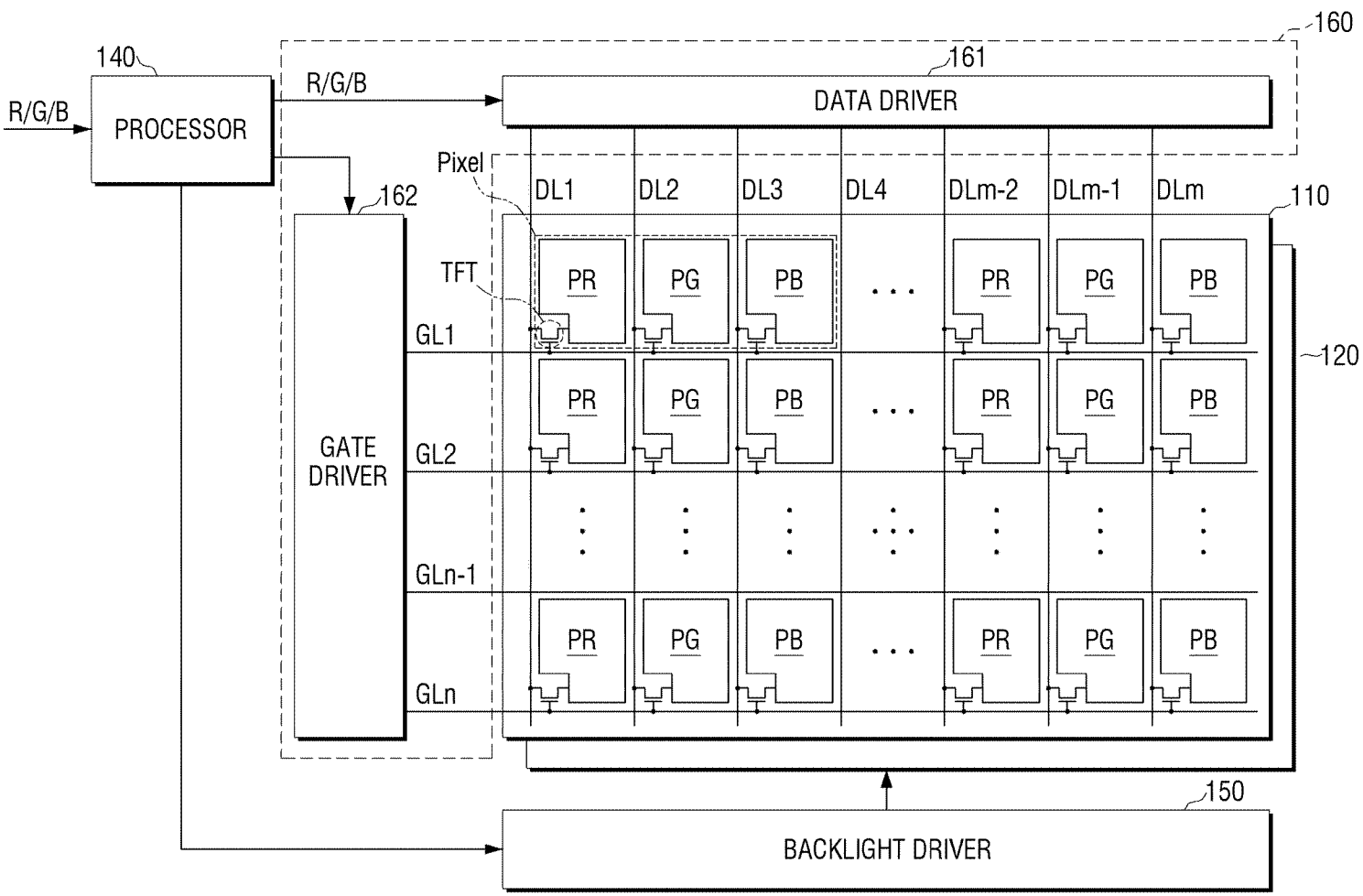

FIGS. 11A and 11B are diagrams illustrating a detailed structure of a display apparatus according to an example embodiment disclosed herein.

Referring to FIG. 11A, a display apparatus 100 may include a display panel 110, a backlight unit 120, a sensor 130, a processor 140, a backlight driver 150, a panel driver 160, and a storage 170. Some of the components of the display apparatus 100 of FIG. 11A are the same as the components of FIG. 2, and a repeated description on the components will be omitted.

The display panel 110 may be realized in the manner that gate lines GL1 to GLn intersect data lines DL1 to DLm, and R, G, B sub pixels PR, PG, PB are formed at the intersections. The adjacent R, G, B sub pixels PR, PG, PB may form one pixel. That is, each pixel may include R-sub pixel PR for displaying red (R), G-sub pixel PG for displaying green, and B-sub pixel PB for displaying blue and realize a color of a subject with three primary colors of red (R), green (G), blue (B).

If the display panel 110 is realized as an LCD panel, the respective sub pixels PR, PG, PB may each include a pixel electrode and a common electrode. As the liquid crystal arrangement is changed by a field effect caused by a potential difference between both electrodes, the optical transmittance may be changed. The Thin Film Transistors (TFT) formed at the intersections of the gate lines GL1 to GLn and the data lines DL1 to DLm may supply video data received from the data lines DL1 to DLm, that is, red (R), green (G), and blue (B) data to the pixel electrodes of the respective sub pixels PR, PG, PB in response to a scan pulse from the respective gate lines GL1 to GLn.

The backlight driver 150 may be realized so as to include a driver IC for driving the backlight unit 120. As an example, the driver IC may be realized as hardware separately from the processor 140. For example, if the light sources included in the backlight unit 120 is realized as LED elements, the driver IC may be realized as at least one LED driver which controls the current applied to the LED elements. According to an embodiment, the LED driver may be installed at the red end of the power supply (for example, Switching Mode Power Supply (SMPS)) and receive power from the power supply. According to another embodiment, the LED driver may receive the power from other power supply device. Further, the LED driver may be realized as a module in which the SMPS and the LED driver are combined.

The panel driver 160 may be realized so as to include a driver IC for driving the display panel 110. As an example, the driver IC may be realized as hardware separately from the processor 140. For example, the panel driver 160 may include a data driver 161 for transmitting video data to the data lines and a gate driver 162 for transmitting a scan pulse to the gate lines.

The data driver 161 may be for generating data signals. The data driver 161 may receive the video data with R/G/B elements from the processor 140 (and/or a timing controller (not shown)) and generate a data signal. Further, the data driver 161 may be connected to the data lines DL1, DL2, DL3, . . . , DLm of the display panel 110 and apply the generated data signals to the display panel 110.

The gate driver 162 (or a scan driver) may be for generating gate signals (or scan signals). The gate driver 162 may be connected to the gate lines GL1, GL2, GL3, . . . , GLn and transmit a gate signal to a certain row of the display panel 110. The data signal outputted from the data driver 161 may be transmitted to the pixel to which the gate signal was transmitted.

The panel driver 160 may further include a timing controller (not shown). The timing controller (not shown) may receive an input signal (IS), a horizontal synchronization signal (Hsync), a vertical synchronization signal (Vsync)), and a main clock signal (MCLK) from an external source, for example, the processor 140, generate an image data signal, a scan control signal, a data control signal, and a light-emitting control signal, and transmit the generated signals to the display panel 110, the data driver 161, and the gate driver 162.

The storage 170 may store diverse data necessary for operations of the display apparatus 100.

To be specific, the storage 170 may store data for the processor 140 to perform various processing operations. As an example, the storage 170 may be realized as an inner memory included in the processor 140, such as, Read-Only Memory (ROM) or Random Access Memory (RAM) or may be realized as a separate memory from the processor 140. In this case, the storage 170 may be realized as a memory embedded in the display apparatus 100 or as a memory detachable from the display apparatus 100 depending upon a purpose of stored data. For example, the data for driving the display apparatus 100 may be stored in the memory embedded in the display apparatus 100, and the data for extended functions of the display apparatus 100 may be stored in the memory detachable from the display apparatus 100. The memory embedded in the display apparatus 100 may be realized as a non-volatile memory, a volatile memory, a flash memory, a Hard Disk Drive (HDD), or a Solid State Drive (SSD), and the memory detachable from the display apparatus 100 may be realized as a memory card (for example, a micro Secure Digital (SD) card or a Universal Serial Bus (USB) memory), or an external memory connectable to a USB port (for example, USB memory).

According to another example embodiment, the above-described information stored in the storage 170 (for example, a current adjusting curve or a pixel data compensation curve) may be acquired from an external apparatus without being stored in the storage 170. For example, some information may be received in real time from an external apparatus, such as, a set-top box, an external sever, or a user terminal.

Figure 12:
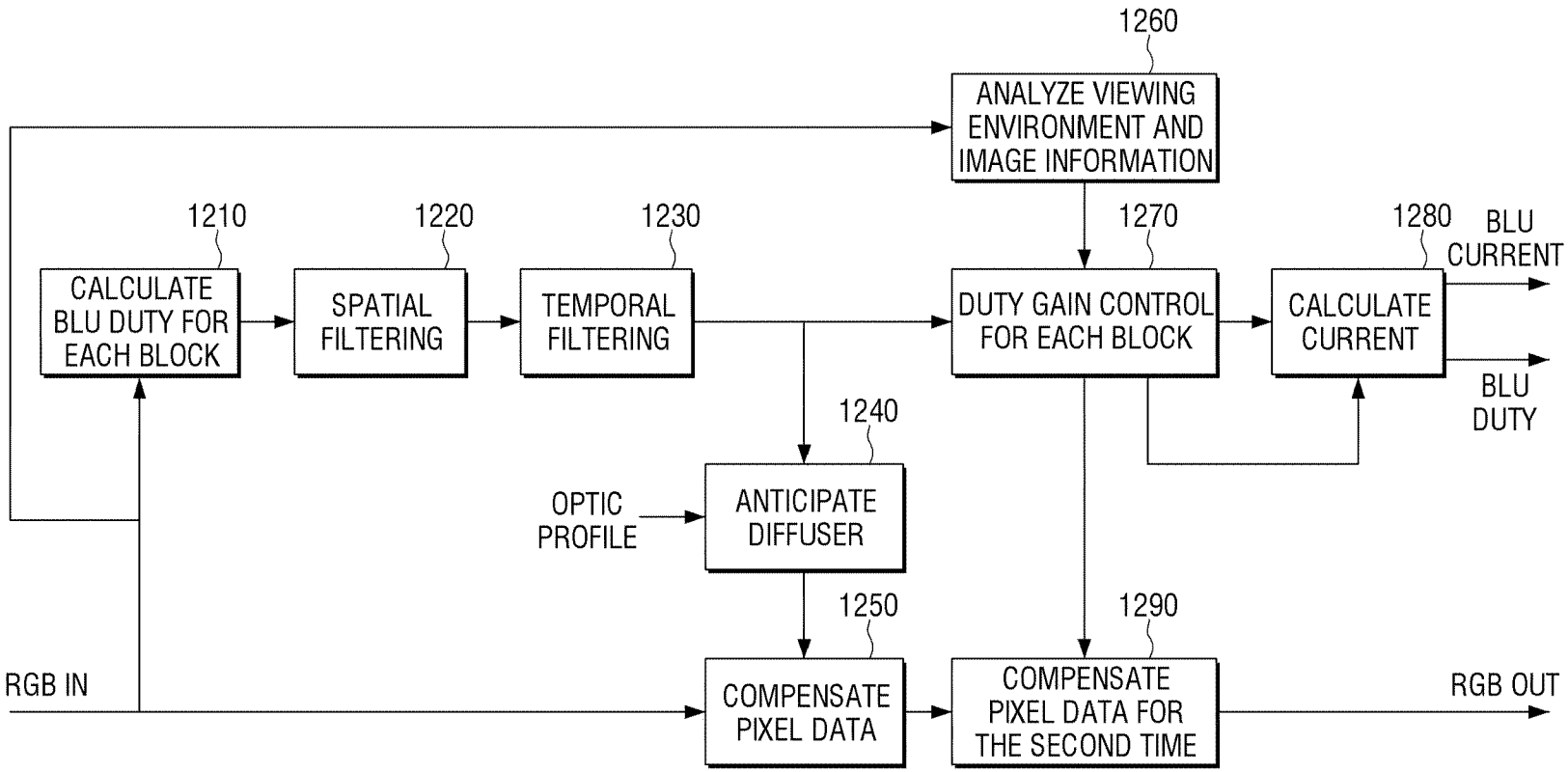
FIG. 12 is a block diagram provided to sequentially describe an operation of processing an image according to an embodiment disclosed herein.

FIG. 12 is a block diagram provided to sequentially describe an operation of processing an image according to an example embodiment disclosed herein.

According to an example embodiment disclosed herein, the processor 140 may calculate a current duty for each backlight block (1210). To be specific, the processor 140 may calculate the current duties of the respective backlight blocks based on RGB pixel information on the image regions corresponding to the respective backlight block.

Further, the processor 140 may perform Spatial Filtering for decreasing a dimming difference of the backlight blocks (1220).

Figure 13A:
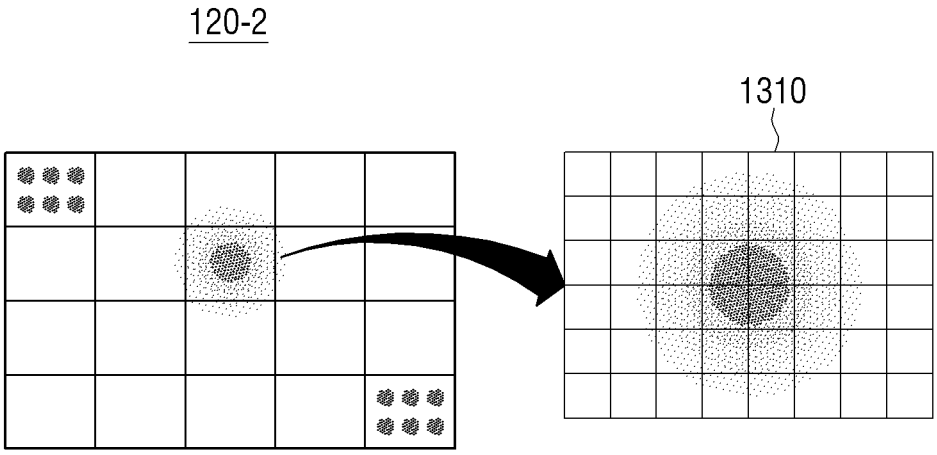
FIGS. 13A and 13B are diagrams provided to describe Spatial Filtering according to an embodiment disclosed herein.
Figure 13B:
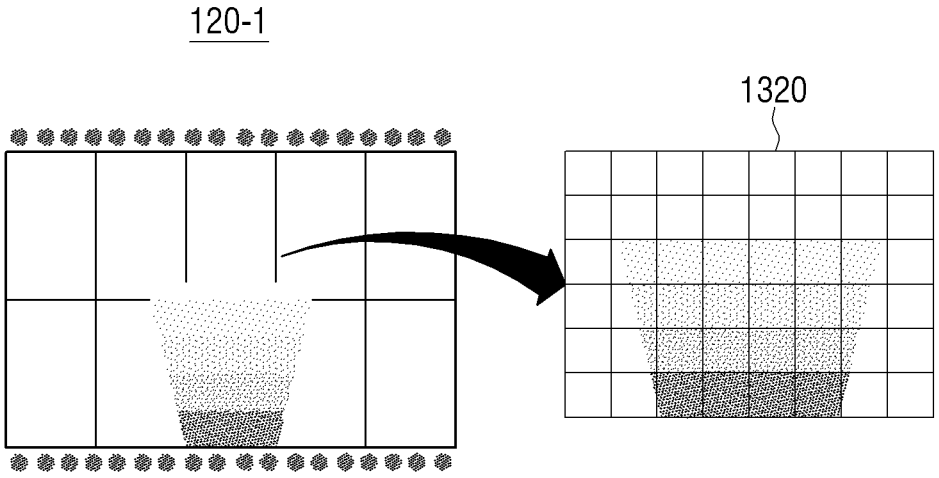

FIGS. 13A and 13B are diagrams provided to describe Spatial Filtering according to an example embodiment disclosed herein.

In response to the local dimming operation, a halo problem may occur due to the dimming difference of the backlight blocks. In order to avoid or reduce this problem, the processor 140 according to an example embodiment disclosed herein may perform Spatial Filtering (or duty spread adjustment) with respect to the current duty for each block in order to reduce the dimming difference of the respective backlight blocks. For example, the processor 140 may adjust the current duty of the corresponding block based on a current duty of an adjacent block of each backlight block. To be specific, the processor 140 may reduce the dimming difference of the adjacent blocks by adjusting the current duty of the present block through the filtering method of applying a spatial filter having a window of a certain size (for example, 3×3) to the current duty of the present block and applying a certain weighted value to the current duties of eight blocks adjacent in every direction to the current duty of the present block.

Further, the processor 140 may perform Temporal Filtering for reducing the brightness difference according to a change of an image (1230).

Generally, in response to the local dimming operation, a flicker problem may occur due to the brightness difference according to a change of an image. According to an example embodiment disclosed herein, in order to avoid or reduce this problem, the processor 140 may perform Temporal Filtering so that the brightness change of the backlight unit 120 proceeds smoothly. For example, the processor 140 may compare N(th) dimming data corresponding to a present frame with N-1(st) dimming data corresponding to a previous frame and perform filtering based on the compassion result so that the brightness change of the backlight unit 120 proceeds slowly for a certain time.

Further, the processor 140 may compensate the pixel data based on an optical profile of the backlight unit 120. To be specific, the processor 140 may anticipate diffuser by analyzing the optical profile of the light sources of the backlights (1240) and compensate the pixel data based on the anticipation (1250).

FIG. 13A illustrates an optical profile of the light sources of the direct type backlight unit 120-1 according to an example embodiment disclosed herein, and FIG. 13B illustrates an optical profile of the light sources of the edge type backlight unit 120-2 according to another example embodiment disclosed herein. As illustrated in FIGS. 13A and 13B, the processor 140 may anticipate the diffuser based on the respective backlight blocks or the optical profile of the respective light sources included in the respective backlight blocks and compensate the pixel data. For example, in response to a diffuser value which affects a certain pixel being high, the processor 140 may adjust a gradation value of the pixel to be reduced.

Further, the processor 140 may analyze a viewing condition and image information (1260), calculate a gain value of a current duty of each backlight block to which the temporal filtering was performed, perform the gain control (1270). For example, the processor 140 may calculate the gain value according to the methods described above in FIGS. 2 to 8B.

The processor 140 may adjust the size of the current based on the duty decreased by the gain control in operation 1270. For example, the processor 140 may change the current value according to the method described in FIG. 9.

In order to compensate the brightness change according to the current duty control, the processor 140 may compensate the pixel data compensated in operation 1250 additionally (1290). For example, the processor 140 may compensate the pixel data additionally according to the method described in FIG. 10.

Figure 14:
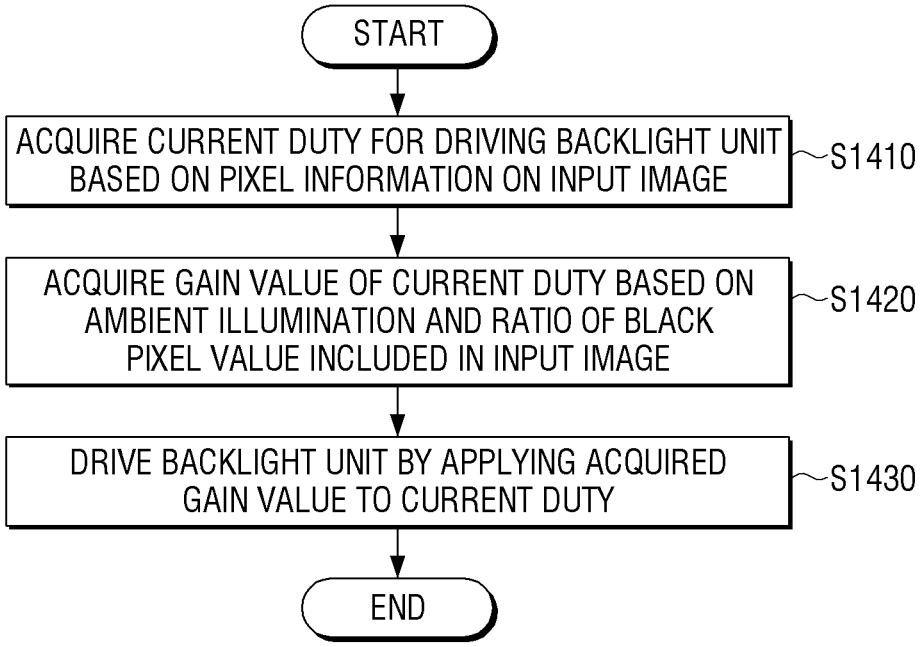
FIG. 14 is a flowchart provided to describe a method for controlling a display apparatus according to an embodiment disclosed herein.

FIG. 14 is a flowchart provided to describe a method for controlling a display apparatus according to an example embodiment disclosed herein.

According to the method for controlling a display apparatus of FIG. 14, a current duty for driving a backlight unit may be acquired based on pixel information on an input image (S1410).

Subsequently, a gain value of the current duty may be acquired based on ambient illumination and a ratio of a black pixel value included in the input image (S1420).

The acquired gain value may be applied to the current duty to drive the backlight unit (S1430).

In this case, in operation S1420 of acquiring the gain value, an input image may be identified as a plurality of block regions, the number of blocks where an average value of each block region is lower than a predetermined threshold value may be counted, and the ratio of the black pixel value may be acquired.

Further, in operation S1420 of acquiring the gain value, if the ambient illumination is lower than a predetermined threshold value, and the ratio of the black pixel value included in the input image being higher than a predetermined ratio, a gain value for decreasing the current duty may be acquired.

Further, in operation S1420 of acquiring the gain value, the gain value may be acquired so that the decreasing rate of the current duty increases with a higher ratio of the black pixel value included in the input image.

Further, in operation S1410 of acquiring the current duty, a plurality of the current duties for driving at least one light source corresponding to each image region may be acquired based on pixel information on image regions corresponding the at least one light source among the plurality of the light sources included in the backlight unit. In this case, in operation S1430 of driving the backlight unit, the acquired gain value may be applied to each of the plurality of acquired current duties.

Further, in operation S1420 of acquiring the gain value, a degree of dispersion of a black pixel value may be acquired based on the pixel information on the respective image regions, and a gain value of each of the plurality of the current duties may be acquired based on the ratio of the black pixel value and the degree of dispersion of the black pixel value.

If the degree of dispersion of the black pixel value is higher than a predetermined degree of dispersion, the method may further include adjusting a difference of the plurality of the current duties to be lower than a predetermined threshold value.

In this case, in operation S1420 of acquiring a gain value, if the degree of dispersion of the black pixel value is lower than a predetermined degree of dispersion, the gain value of each of the plurality of the current duties may be acquired based on the pixel information on the respective image regions.

According to above-described various embodiments, the black visibility may be improved under the darkroom viewing condition, thereby enhancing the user convenience.

Meanwhile, at least some of the methods in the above-described embodiments may be realized as an application which may be installed in at least one of the conventional display apparatus and an electronic apparatus which provides the conventional display apparatus with an image.

At least some of the above-described embodiments may be realized by software upgrade or hardware upgrade with respect to at least one of the conventional electronic apparatus and the conventional display apparatus.

At least some of the above-described embodiments may be executed through an embedded server installed in at least one of the electronic apparatus and the display apparatus or through an external server of at least one of the electronic apparatus and the display apparatus.

At least some of the above-described embodiments may be realized in a recording medium which is readable by a computer or the like by using software, hardware, or a combination thereof. In some cases, at least some of the embodiments disclosed herein may be realized as the processor 140. According to software implementation, at least some of the processes or functions in the embodiments disclosed herein may be realized as software modules. Each of the software modules may perform one or more functions and operations described herein.

Meanwhile, computer instructions for performing processing operations of the display apparatus 100 according to the above-described various embodiments may be stored in a non-transitory computer-readable medium. The computer instructions stored in the non-transitory computer-readable medium may enable a certain device to perform the processing operations of the display apparatus 100 according to the above-described various embodiments when being executed by a processor of the certain apparatus.

The non-transitory computer-readable medium refers to a machine-readable medium that stores data semi-permanently unlike a register, a cache, or a memory that stores data for a short time. To be specific, the non-transitory computer-readable medium may include a Compact Disc (CD), a Digital Versatile Disc (DVD), a hard disc, a Blu-ray disc, a Universal Serial Bus (USB), a memory card, a Read-Only Memory (ROM), or the like.

As above, a few embodiments have been shown and described. The foregoing embodiments and advantages are merely exemplary and are not to be construed as limiting the present disclosure. The present teaching can be readily applied to other types of devices. Also, the description of the embodiments is intended to be illustrative, and not to limit the scope of the claims, and many alternatives, modifications, and variations will be apparent to those skilled in the art.

What is claimed is:

1. A display apparatus comprising:

a display panel;

a backlight;

a sensor; and a processor configured to drive the backlight so as to provide the display panel with light, wherein the processor is configured to:

acquire a current duty for driving the backlight based at least on pixel information of an input image, acquire a ratio of pixels with gray scale near black based on gray scale of each of the pixels included in the input image, acquire a gain value of the current duty based at least on ambient illumination sensed by the sensor and the ratio of pixels with gray scale near black included in the input image, and drive the backlight by applying the acquired gain value to the current duty.

2. The apparatus as claimed in claim 1, wherein the processor is configured to identify the input image as a plurality of block regions and acquire the ratio of pixels value at least by counting the number of blocks where an average value of each block region is lower than a predetermined threshold value.

3. The apparatus as claimed in claim 1, wherein when ambient illumination is lower than a predetermined threshold value and the ratio of pixels in the input image is higher than a predetermined ratio, the processor is configured to acquire a gain value for decreasing the current duty and apply the acquired gain value to the current duty.

4. The apparatus as claimed in claim 3, wherein the processor is configured to calculate the gain value so that a decreasing rate of the current duty increases as the ratio of pixels increases.

5. The apparatus as claimed in claim 1, wherein the processor is configured to acquire a plurality current duties for driving at least one light source corresponding to respective image regions among a plurality of light sources included in the backlight based at least on pixel information of the image regions respectively corresponding to the at least one light source and to apply the acquired gain value to each of the plurality of current duties.

6. The apparatus as claimed in claim 5, wherein the processor is configured to acquire a degree of dispersion of the black pixel value based on the pixel information on the respective image regions and to acquire a gain value of each of the plurality of current duties based on the ratio of pixels and the degree of dispersion of the black pixel value.

7. The apparatus as claimed in claim 6, wherein when the degree of dispersion of the black pixel value is higher than a predetermined degree of dispersion, the processor is configured to adjust a difference of the plurality of current duties to be lower than a predetermined threshold value.

8. The apparatus as claimed in claim 6, wherein when the degree of dispersion of the black pixel value is lower than a predetermined degree of dispersion, the processor is configured to acquire a gain value of each of the plurality of current duties based on the pixel information on the respective image regions.

9. The apparatus as claimed in claim 1, further comprising:

a storage configured to store a first current adjusting curve and a second current adjusting curve, wherein when the ambient illumination is higher than a predetermined threshold value, the processor is configured to apply a current value according to the current duty based on the first current adjusting curve, wherein when the ambient illumination is lower than a predetermined threshold value, the processor is configured to apply a current value according to the current duty based on the second current adjusting curve, wherein the second current adjusting curve is a curve where a variable quantity of a current according to the current duty appears to be gentle as compared with the first current adjusting curve.

10. The apparatus as claimed in claim 1, wherein the processor is configured to acquire a compensation value for compensating for a brightness change according to application of the gain value with respect to at least one pixel value other than the black pixel value and to compensate the at least one pixel value.

11. The apparatus as claimed in claim 1, wherein the display panel is a Liquid Crystal Display (LCD) panel.

12. A method for controlling a display apparatus, the method comprising:

acquiring a current duty for driving a backlight based on pixel information regarding an input image;

acquiring a ratio of pixels with gray scale near black based on gray scale of each of the pixels included in the input image, acquiring a gain value of the current duty based at least on ambient illumination and the ratio of pixels with gray scale near black included in the input image; and driving the backlight at least by applying the acquired gain value to the current duty.

13. The method as claimed in claim 12, wherein the acquiring the gain value comprises identifying the input image as a plurality of block regions, and acquiring the ratio of pixels by counting the number of blocks where an average value of each block region is lower than a predetermined threshold value.

14. The method as claimed in claim 12, wherein when the ambient illumination is lower than a predetermined threshold value, and the ratio of pixels in the input image is higher than a predetermined ratio, the acquiring the gain value comprises acquiring a gain value for decreasing the current duty.

15. The method as claimed in claim 14, wherein the acquiring the gain value comprises calculating the gain value so that a decreasing rate of the current duty increases as the ratio of pixels increases.

16. The method as claimed in claim 12, wherein the acquiring the current duty comprises acquiring a plurality of current duties for driving at least one light source corresponding to respective image regions among a plurality of light sources included in the backlight based at least on pixel information on the image regions respectively corresponding to the at least one light source, wherein the driving the backlight comprises applying the acquired gain value to each of the plurality of current duties.

17. The method as claimed in claim 16, wherein the acquiring the gain value comprises acquiring a degree of dispersion of the black pixel value based at least on the pixel information on the respective image regions and acquiring a gain value of each of the plurality of current duties based at least on the ratio of pixels and the degree of dispersion of the black pixel value.

18. The method as claimed in claim 17, further comprising: adjusting, when the degree of dispersion of the black pixel value is higher than a predetermined degree of dispersion, a difference of the plurality of current duties to be lower than a predetermined threshold value.

19. The method as claimed in claim 17, wherein when the degree of dispersion of the black pixel value is lower than a predetermined degree of dispersion, the acquiring the gain value comprises acquiring a gain value of each of the plurality of current duties based on the pixel information on the respective image regions.

20. A non-transitory computer-readable medium with computer instructions to be executed by a processor to perform an operation, the operation comprising:

acquiring a current duty for driving a backlight of a display based on pixel information of an input image;

acquire a ratio of pixels with gray scale near black based on gray scale of each of the pixels included in the input image, acquiring a gain value of the current duty based on ambient illumination and the ratio of pixels with gray scale near black included in the input image; and applying the acquired gain value to the current duty.

* * * * *